US005499592A

United States Patent [19]

Monfort

[11] Patent Number: 5,499,592

[45] Date of Patent: Mar. 19, 1996

[54] AQUATIC AMUSEMENT DEVICE

[76] Inventor: Robert W. Monfort, 1515 Harding St., Hollywood, Fla. 33020

[21] Appl. No.: 292,064

[22] Filed: Aug. 17, 1994

Related U.S. Application Data

[63] Continuation of Ser. No. 105,303, Aug. 11, 1993, abandoned, which is a continuation of Ser. No. 833,629, Feb. 7, 1992, Pat. No. 5,263,430, which is a continuation of Ser. No. 499,019, Mar. 26, 1990, abandoned.

[51] Int. Cl.[6] ..... B63B 21/56

[52] U.S. Cl. ..... 114/244; 114/242

[58] Field of Search ..... 114/65 R, 66, 114/242–245, 294, 303, 312, 315; 441/135; 354/64; 272/1 B, 71; 446/161; D12/301; 472/13, 128, 129

[56] References Cited

U.S. PATENT DOCUMENTS

| | | | |
|---|---|---|---|
| 294,813 | 3/1884 | Schmeelk | 114/303 |
| 2,948,251 | 8/1960 | Replogle | 114/245 |
| 3,139,055 | 6/1964 | Nutting | 114/245 |
| 3,261,318 | 7/1966 | Jones et al. | 114/245 |
| 3,442,240 | 5/1969 | Wild et al. | 114/315 |
| 3,453,980 | 7/1969 | Shock | 114/245 |
| 4,813,367 | 3/1989 | Stevenson | 114/315 |
| 5,263,430 | 11/1993 | Monefort | 114/244 |

FOREIGN PATENT DOCUMENTS

| | | | |
|---|---|---|---|
| 2174346 | 11/1986 | United Kingdom | 114/303 |

*Primary Examiner*—Robert J. Oberleitner
*Assistant Examiner*—C. T. Bartz
*Attorney, Agent, or Firm*—Malin, Haley, DiMaggio & Crosby

[57] ABSTRACT

An aquatic amusement device having forward and aft fins which are secured to a two part longitudinal shaft so the fins rotate on the same axis and with relative rotational motion. The device can be towed behind a boat, winch or other towing apparatus, the rider being positioned behind the device while grasping a handle secured to the aft fins. The device provides excellent maneuverability on or below the surface of the water.

4 Claims, 2 Drawing Sheets

AQUATIC AMUSEMENT DEVICE

This application is a continuation of application Ser. No. 08/105,303 filed Aug. 11, 1993, now abandoned, which is a continuation of application Ser. No. 07/833,629 filed Feb. 7, 1992, now U.S. Pat. No. 5,263,420, which in turn is a continuation of Ser. No. 07/499,019 filed Aug. 26, 1990, now abandoned.

BACKGROUND OF THE INVENTION

1. Field of the Invention

The instant invention relates to aquatic amusement devices and more particularly relates to a tethered hydroplane device comprising a plurality of planar forward and aft fins arranged perpendicularly, the device adapted to be pulled through a body of water and to in turn pull the device's operator through the water.

SUMMARY OF THE INVENTION

The instant invention relates to an aquatic amusement device, namely a tethered hydroplane device comprising a plurality of planar forward and aft fins arranged perpendicularly. The device is divided into a forward member rotatably connected to an aft member. Tethering means are connected to the forward member to allow a tow means such as a powered watercraft to pull the device through a body of water. Handle means are connected to the aft member, allowing an operator to grasp the handle means and be towed both above and below the surface and to perform a multitude of maneuvers therein by altering the pitch, yaw and roll axes of the device relative to the direction of tow.

The device is preferably buoyant to facilitate the easy location and retrieval thereof.

It is a principal object of the instant invention to provide an aquatic amusement device capable of being pulled through the water and adapted to be easily grasped by an operator, allowing the operator to perform maneuvers in an infinite number of directions both below and on the surface of the water.

It is also an object of the instant invention to provide a tethered hydroplane device having a forward member rotatably connected to an aft member, the hydroplane device adapted to be pulled through the water and maneuvered by the operator to "steer" along a desired path.

It is a still further object of the instant invention to provide a tethered hydroplane device wherein the tethering means is connected to a forward member, which forward part is rotatable relative to an aft member, the rotatability of the forward member relative to the aft member preventing the tethering means from becoming tangled or twisted when the operator grasps handles connected to the aft member and is pulled through the water.

It is yet a further object of the instant invention to provide a tethered hydroplane device comprising a plurality of planar forward and aft fins perpendicularly connected wherein the point of connection of the tethering means is generally coincident with the point of connection of handle means, both being at or near the center of lateral resistance of the device thereby facilitating easy maneuverability of the device.

In accordance with these and other objects which will be apparent hereinafter, the instant invention will now be described with particular reference to the accompanying drawings.

DETAILED DESCRIPTION OF THE PREFERRED EMBODIMENT

Figure 2:
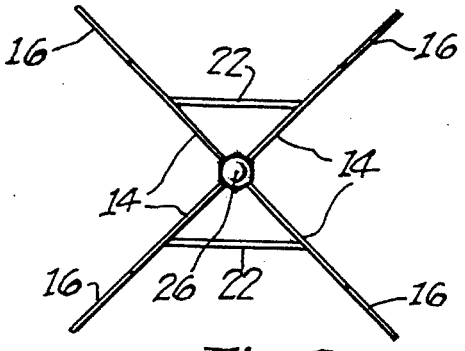
FIG. 2 is a top plan view of the instant invention showing the fins of the forward part aligned with the fins of the aft member.
Figure 2A:
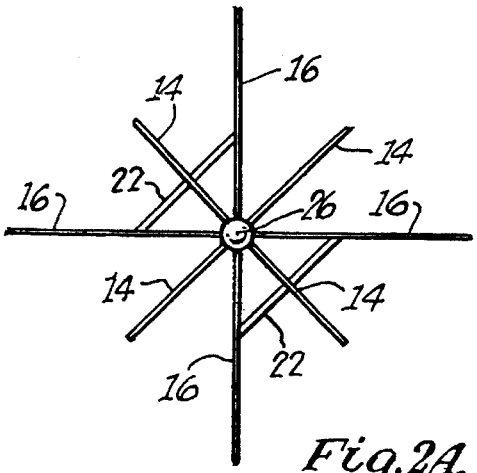
FIG. 2A is a top plan view of the instant invention showing the forward member rotated relative to the aft member.
Figure 1:
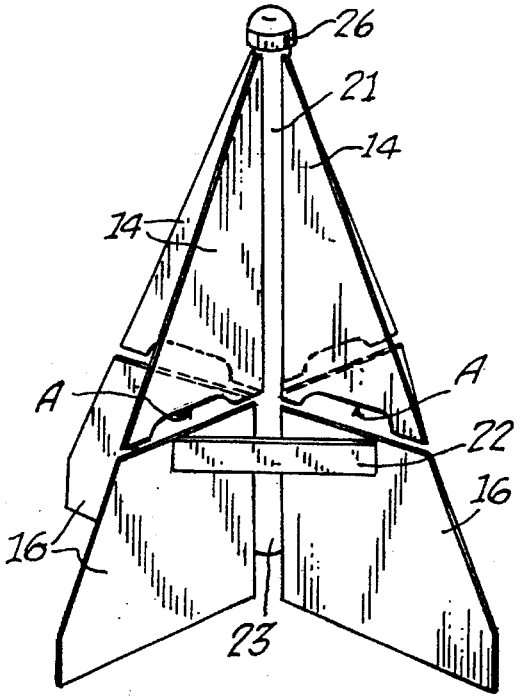
FIG. 1 is a perspective view of the aquatic amusement device of the instant invention showing the forward member connected to the aft member.
Figure 3:
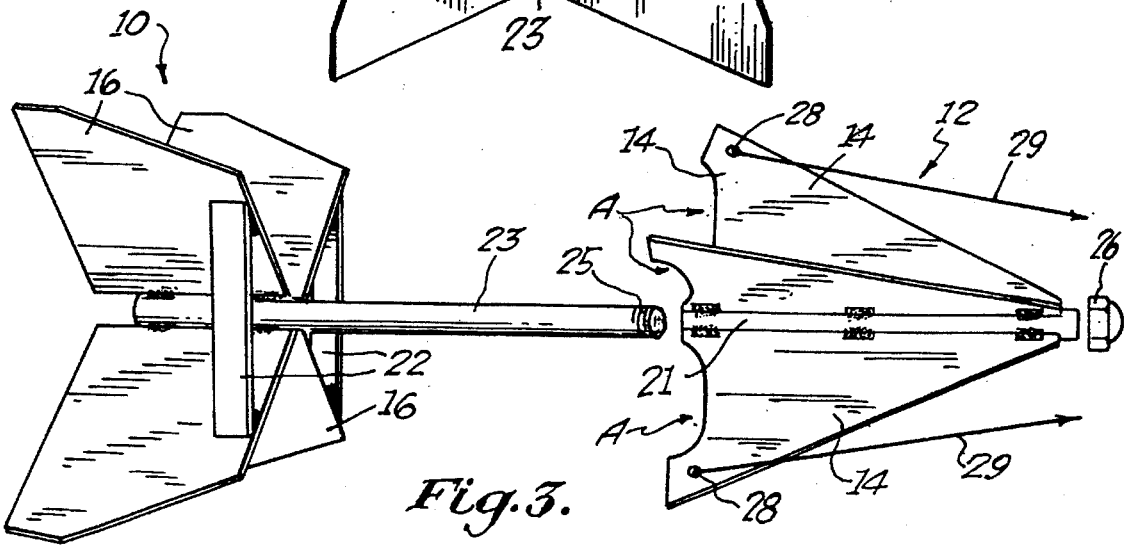
FIG. 3 is an exploded view of the invention.

The aquatic amusement device is shown in FIG. 1 comprising two main member, an aft member 10 and a forward member 12. In the preferred embodiment, the aft member 10 has four aft fins 16. As shown in FIG. 2, these aft fins 16 extend radially from shaft 23. In the preferred embodiment, the aft fins 16 are flat and pentagonal shaped. Shaft 23 has threads 25 on one end adapted to receive holding means such as nut 26. The aft fins 16 are rigidly connected to shaft 23 opposite threads 25, shaft 23 extending beyond the forward terminus of fins 16. For purposes of this disclosure, "forward" shall be defined as toward the right of the device shown in FIG. 3 and "rearward" or "aft" to the left therein.

Handles 22 are provided to allow the operator to grasp the aft member 10. In the preferred embodiment, the handles extend between two of the aft fins 16 on opposite sides of shaft 23 and are spaced a sufficient distance from shaft 23 to allow easy grasping by the operator.

The forward part 12 of the instant invention comprises four forward fins 14 rigidly connected relative to one another at tube 21. In the preferred embodiment, forward fins 14 are triangularly shaped and have a notch or cut-out A on one edge of each of the forward fins 14. Said tube 21 defines a hollow, preferably cylindrical, interior adapted to be placed in concentric rotatable relationship about shaft 23. Said hollow interior of tube 21 is defined by an interior surface of tube 21 having a diameter only slightly larger than the outer diameter of shaft 23, thereby allowing free rotation of aft member part 10 relative to forward member 12. Forward member 12 is held in place relative to aft member 10 by any convenient holding means, such as threaded nut 26. Said nut 26 preferably has a curved outer face to enhance the hydrodynamic properties of the device.

Cut-outs A are provided near the rearward edge of forward fins 14, close to aft member 10. The cut-outs A allow the fins 14 to move freely past the operator's hands while grasping handle 22 as the aft part 10 turns around the axis of shaft 23 relative to the forward member 12.

In operation, as shown in FIG. 1, forward member 12 is placed forward of aft member 10 so that shaft 23 is disposed through tube 21. A nut 26 is placed on threads 25 to restrain forward member 12 on shaft 23 against longitudinal, or forward to aft, movement. Although nut 26 restrains forward member 12 in this manner, forward member 12 is allowed to rotate freely around shaft 23 thereby eliminating the problem of tow ropes 29 or 32 being twisted or tangled. Any known means for allowing such relative rotational movement such as a bearing system is considered to be within the scope of the invention.

Apertures 28 are provided near the outboard aft edges of two of forward fins 14 to allow tow means such as line 29 to be connected to the device. One end of tow line 29 is connected to the apertures 28, while the other end is connected to a yoke 30 which in turn is connected to the aft end of main tow line 32.

The forward end of main tow line 32 is connectable to a tow means such as a boat or towing system.

The position of apertures 28 is chosen to be near or at the center of lateral resistance for the entire device. Because forward member 12 may rotate around shaft 23 independent of aft member 10, tow lines 29 never interfere with or become tangled with the operator or the device.

It has been found that ideal dimensions for the present invention are a combined height of the forward and aft members 10 and 12 of approximately 28 inches and a width at the widest part of the cross section of the aft fins 16 of about 25 inches, for a single user. Obviously, larger dimensions would be employed for multiple-user devices. The forward and aft fins 14, 16 and handles 22 may be made of any rigid material such as wood, aluminum, plastic, stainless steel or fiberglass. If a material having negative buoyancy is chosen, the device can be made buoyant by adding flotation foam either between outer surfaces of the forward or aft fins or around the tube 21 and shaft 23 where the respective forward and aft fins 14, 16 are connected, or by covering fins 14, 16 or the entire device with positive buoyancy material.

The center of lateral resistance referred to above relates to the point at which a force directed perpendicularly away from the longitudinal axis of shaft 23 and tube 21 would raise the device of the instant invention without either the aft end or the forward end of the device tipping.

Figure 4:
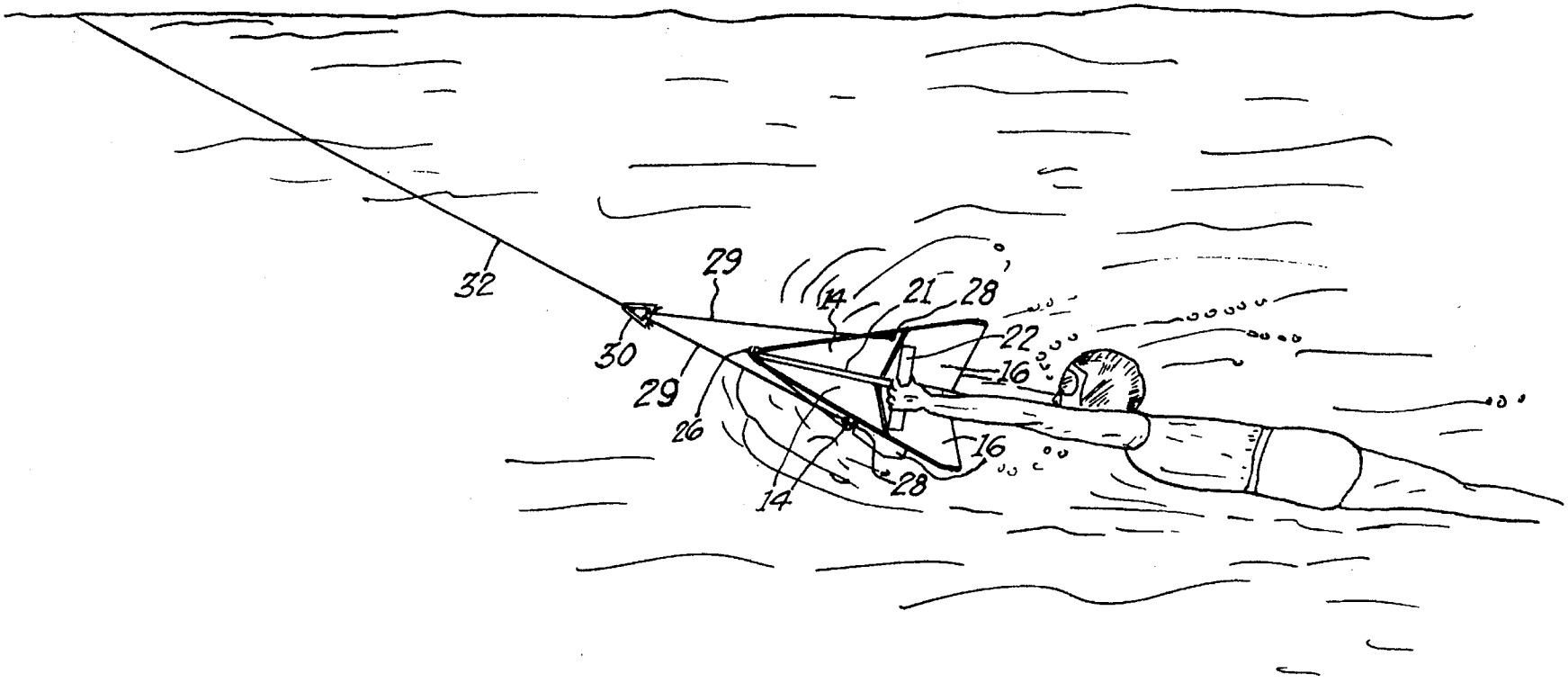
FIG. 4 is a perspective view showing an operator being pulled through a body of water using the aquatic amusement device of the instant invention.

To use the device, as shown in FIG. 4, the aft end of tow line 32 is connected to a source of propulsion and the operator grasps the handles 22. As the device begins to move, either on the surface of or under the water, hydrodynamic forces begin to act on forward and aft fins 14, 16. By manually rotating aft member 10 by operator pressure on handles 22, or by pulling on handles 22, a change in hydrodynamic pressure on various of the forward and aft fins 14, 16 is achieved. This change of force manifests itself in a variety of ways. The aft member 10 may begin to rotate around shaft 23 or the device may begin to move in a direction lateral to the direction of towing or both. Testing of the device has shown that an operator can do a 360 degree "barrel roll" under water while traveling at a 70 degree angle from the direction of propulsion. It should be noted that placing the handles 22 at or near the center of lateral resistance, the device is more easily manipulated as that is the point at or near the center of where both the towing and hydrodynamic forces act on the device.

It should be noted that the device may be combined with adjunct equipment such as a camera or cameras or a depth gauge. In one embodiment, a camera and watertight housing therefore may be located in the center of shaft 23. Therefore, in such case, shaft 23 must be sized appropriately. Alternatively, a camera or cameras may be connected to arms so as to be rigidly placed relative to the device at a point remote from the device. Lighting means for underwater photography, both still and motion type, may also be employed. Still further, a depth gauge may be connected to the device so as to alert the diver to the depth at which he or she may be approaching to avoid possible decompression problems relative to descent and ascent beyond certain limits.

The instant invention has been shown and described herein in what is considered to be the most practical and preferred embodiment. While there has been a description above of the principles of this invention in connection with a specific apparatus, it is to be clearly understood that this description is made only by way of example and not as a limitation to the scope of the invention. It is recognized that departures may be made therefrom within the scope of the invention and that obvious modifications will occur to a person skilled in the art.

I claim:

1. A device by which a rider may be towed below or on the surface of a body of water behind the device, said device comprising:

a forward member comprising a first longitudinally extending shaft and forward fins which extend from said first shaft;

an aft member comprising a second longitudinally extending shaft and aft fins which extend from said second shaft, wherein said first shaft and said second shaft are rotatably connected in axial alignment;

means for grasping said aft member, said means for grasping comprising at least one handle being directly connected between adjacent fins; and said forward fins each defining a cut-out to permit a full range of rotational movement of said forward fins relative to said aft fins when said means for grasping are grasped by the rider.

2. The device of claim 1, wherein each of said forward fins is planar.

3. The device of claim 1, wherein each of said aft fins is pentagonal.

4. A device as recited in claim 1, wherein said first shaft is hollow and said second shaft is at least partially generally concentrically disposed within said first shaft.

* * * * *